US007015815B1

(12) United States Patent
Feibelman

(10) Patent No.: US 7,015,815 B1
(45) Date of Patent: Mar. 21, 2006

(54) ANTI-THEFT HANGER

(75) Inventor: Jeffrey A. Feibelman, Providence, RI (US)

(73) Assignee: Display Technologies, Inc., Johnston, RI (US)

( * ) Notice: Subject to any disclaimer, the term of this patent is extended or adjusted under 35 U.S.C. 154(b) by 146 days.

(21) Appl. No.: 10/717,229

(22) Filed: Nov. 19, 2003

(51) Int. Cl.
*G08B 13/14* (2006.01)

(52) U.S. Cl. ..... 340/572.8; 206/6.1; 223/85; 340/568.1

(58) Field of Classification Search ..... 235/385, 235/492, 491; 340/572, 568.8, 571; 211/13.1, 211/85–98, 6.1, 278
See application file for complete search history.

(56) References Cited

U.S. PATENT DOCUMENTS

| | | | | |
|---|---|---|---|---|
| 3,065,946 | A * | 11/1962 | Berkow | 248/317 |
| 5,100,006 | A | 3/1992 | Forrester | |
| 5,437,172 | A | 8/1995 | Lamy et al. | |
| D368,591 | S | 4/1996 | Doyle, III | |
| 5,560,970 | A | 10/1996 | Ludebuhl | |
| 5,593,025 | A | 1/1997 | Feibelman | |
| 5,597,100 | A * | 1/1997 | Blitz | 223/85 |
| 5,631,631 | A | 5/1997 | Deschenes | |
| 5,717,382 | A | 2/1998 | Cooper | |
| 5,775,504 | A | 7/1998 | Menaged | |
| 5,867,102 | A | 2/1999 | Souder et al. | |
| 5,884,425 | A | 3/1999 | Baldwin | |
| 5,945,909 | A | 8/1999 | Kolton | |
| 5,949,336 | A | 9/1999 | Deschenes et al. | |
| 5,982,282 | A | 11/1999 | Ryan, Jr. | |
| 5,982,284 | A | 11/1999 | Baldwin et al. | |
| 5,986,562 | A | 11/1999 | Nikolich | |
| 5,988,462 | A * | 11/1999 | Kolton | 223/85 |
| 6,023,871 | A | 2/2000 | Horowitz | |
| 6,025,781 | A | 2/2000 | Deschenes | |
| 6,067,016 | A | 5/2000 | Deschenes et al. | |
| 6,073,758 | A | 6/2000 | Webster et al. | |
| 6,135,407 | A | 10/2000 | Havis et al. | |
| 6,157,302 | A | 12/2000 | Kolton et al. | |
| 6,199,309 | B1 | 3/2001 | Markarian | |
| 6,254,953 | B1 | 7/2001 | Elston | |
| 6,264,077 | B1 * | 7/2001 | Kolton et al. | 223/87 |
| 6,330,758 | B1 | 12/2001 | Feibelman | |
| 6,433,686 | B1 | 8/2002 | Feibelman | |
| 6,567,003 | B1 | 5/2003 | Kolton et al. | |
| 6,724,311 | B1 * | 4/2004 | Kolton et al. | 340/572.8 |
| 2003/0174058 | A1 * | 9/2003 | Kolton et al. | 340/572.8 |
| 2005/0035004 | A1 * | 2/2005 | Kolton et al. | 206/6.1 |

* cited by examiner

*Primary Examiner*—Jeffery Hofsass
*Assistant Examiner*—Hoi C. Lau
(74) *Attorney, Agent, or Firm*—Bowditch & Dewey, LLP

(57) ABSTRACT

An anti-theft display hanger includes a body portion having at a first member including at least one recess for supporting an electronic article surveillance sensor, and a second member designed to overlay the first member. The EAS sensor is preferably supported within the recess of the first member such that it is substantially co-planar with or below an inside surface of the first member. The body portion is preferably folded such that the second member at least partially overlays the first member. The first and second members are preferably connected by a bridge for supporting an article. In one embodiment, the bridge forms a planar surface for supporting the article, for example a necklace, when the second member overlays the first. An engagement member may also be provided for supporting the hanger on a display.

17 Claims, 8 Drawing Sheets

ANTI-THEFT HANGER

DESCRIPTION

1. Technical Field

The invention relates generally to an anti-theft hanger and, more specifically to an improved anti-theft display hanger for supporting an article and concealing an electronic article surveillance sensor.

2. Background of Related Art

Various devices have been utilized by retailers in order to prevent theft of their goods. A widespread practice in the industry of article security is the use of anti-theft tags which incorporate electronic article surveillance (EAS) sensors. These types of tags are typically secured to an article and are either removed or rendered inactive at checkout. In some cases the sensors are visible to consumers, and in other cases the sensors are hidden from view in order to is prevent unauthorized removal. In either case, if the sensors are not rendered inactive or removed, they will be sensed by the EAS system causing an alarm to signal, for example when exiting the store. It is desirable that anti-theft tags be easy to manufacture and apply to the article while being difficult to detect and/or to remove by consumers.

One common form of EAS sensors is a flat, thin, flexible rectangular member which is applied adhesively to a flat or curved exterior surface of the article. One shortcoming of such exterior surface application by adhesive is that the sensor may be easily seen and removed by a consumer. Attempts have been made to manufacture thin, flat EAS sensors which are laminated between sheets of a tag or label so as to not be noticeably visible to the consumer. For example, U.S. Pat. No. 5,982,284 to Baldwin et al. describes an anti-theft tag or label that has a thin, flat, flexible device laminated within the tag or label in such a manner that the edges of the device are masked so as not to give away the presence of the device. While these attempts have had some success, they can present manufacturing difficulties. In addition, some articles (for example glasses and jewelry) are inherently difficult to apply EAS sensors to without detecting the sensor. Such articles are generally small in size and do not have many areas to attach such a sensor.

U.S. Pat. No. 6,433,686, whose inventor is the same as the present inventor, discloses an anti-theft tag for attaching to an article, such as a pair of glasses, and which includes an EAS sensor supported within the body portion of the tag. The body portion includes at least a first member for supporting an electronic article surveillance sensor, and a second member including an opening disposed entirely there through. In this manner, the EAS sensor can be supported on the planar surface of the first member, extend through the opening of the second member, and may project from the other side of the opening, if desired.

Some tags containing EAS sensors are attached to articles, while other tags, i.e. hangers, support the articles, for example on a display rack. Therefore, hangers having EAS sensors perform the function of supporting and displaying the article while also protecting it from theft.

Accordingly, there is continued development in the art of anti-theft tags and hangers to develop those which are easy to manufacture, and which can be used without being readily discovered and/or removed by consumers.

SUMMARY

An object of the present invention is to provide an anti-theft display hanger which is easy to manufacture and assemble, cost effective, and which can be used without being readily discovered and/or removed by consumers.

In accordance with one aspect, there is provided an anti-theft display hanger including a body portion having at least a first member including a recess for supporting an electronic article surveillance sensor, and a second member designed to overlay the first member. The EAS sensor is preferably supported within the recess of the first member such that it is substantially co-planar with or below the inside surface of the first member. The body portion is preferably folded such that the second member at least partially overlays the first member. In a first embodiment, the first and second members are connected by a bridge, the bridge forming a planar surface for supporting an article, for example a necklace, when the second member overlays the first. An engagement member, for example a hook, may also be provided for supporting the hanger on a rod or the like. The body portion may also include indicia, such as price, manufacturer, or other information for display to the consumer.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

Figure 1:
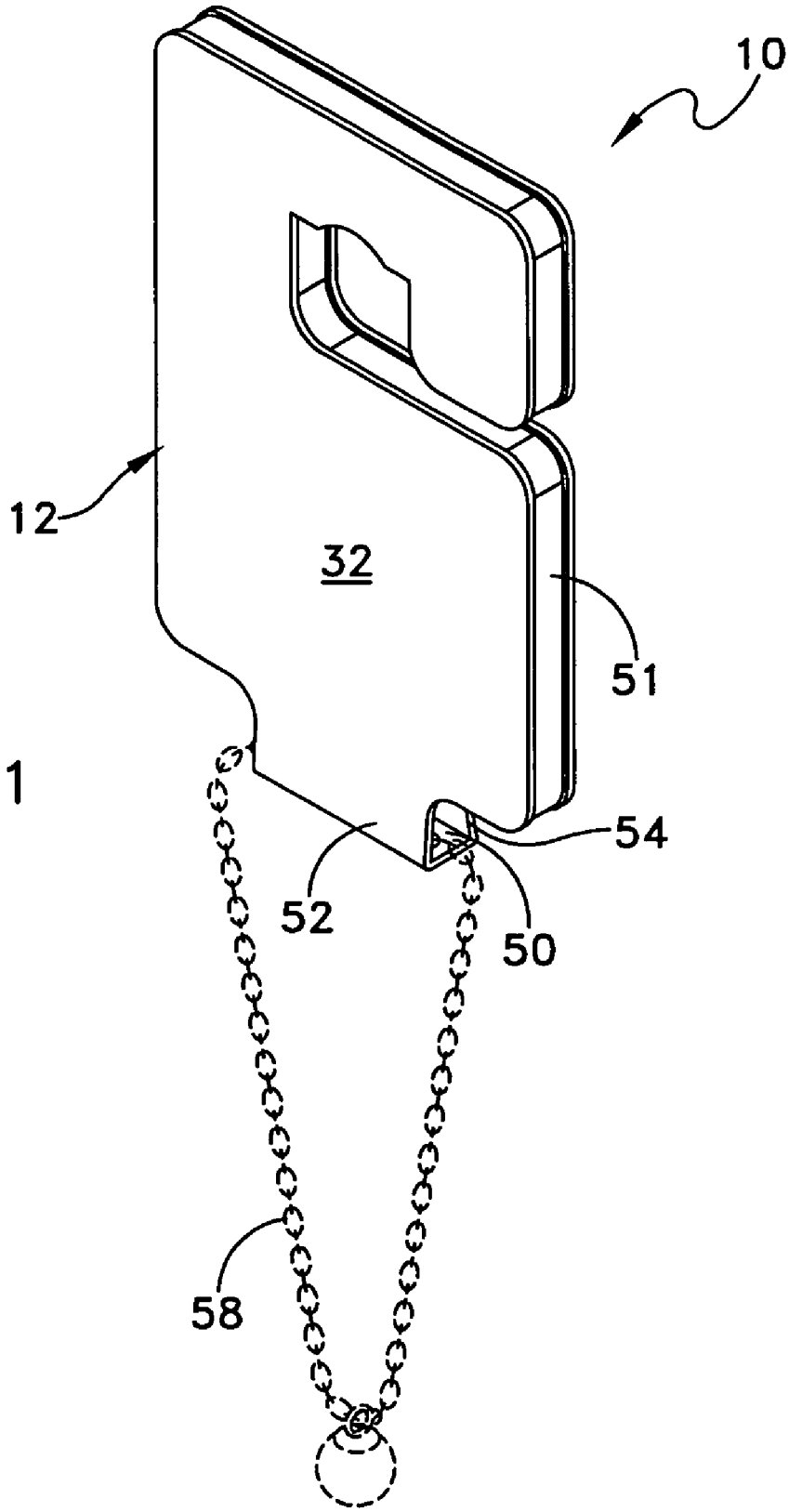
FIG. 1 is a perspective view of the anti-theft display hanger in a closed position, during use, according to a first embodiment.
Figure 2:
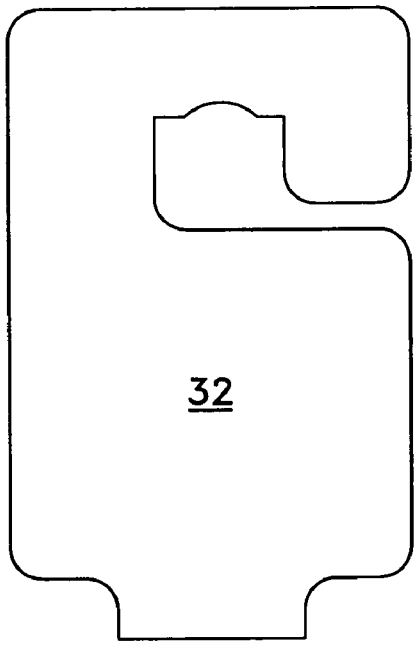
FIG. 2 is a front elevational view of the embodiment of FIG. 1.
Figure 3:
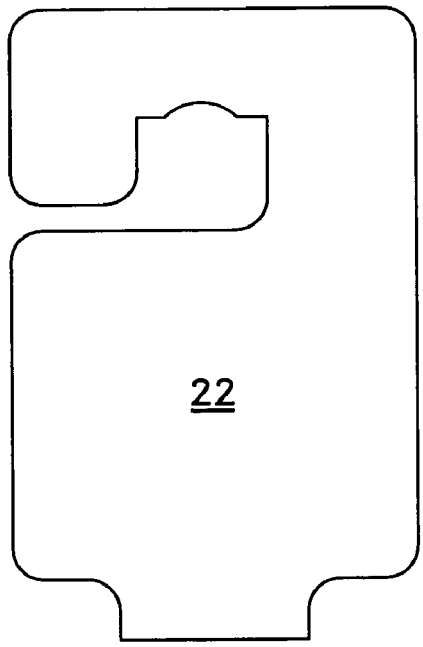
FIG. 3 is a rear elevational view of the embodiment of FIG. 1.

A first embodiment of an anti-theft display hanger 10 for supporting an article and deterring theft of the article is illustrated in FIGS. 1–9. As used herein, the term "article" refers to any item or product sold to a consumer, and is not limited to the particular articles disclosed herein. As also used herein, the term "EAS sensor" or "EAS marker" are used in the conventional sense to mean any of a number of electronic article surveillance sensors, as would be known to those of skill in the art. For example, the EAS sensor may comprise a ferro magnetic member. EAS sensors are widely available and may be purchased from such companies as Sensormatic Electronics Corporation of Boca Raton, Fla.

Anti-theft display hanger 10 includes a body portion 12 having at least a first member 14 including a recess 16 sized to support a conventional electronic article surveillance sensor 18, and a second member 20 designed to at least partially overlay the first member. The first member preferably includes an outer surface 22, an inner surface 24, a top portion 26 and a bottom portion 28. The first member also preferably has a thickness "t" defined between the outer surface and inner surface which is of sufficient thickness to form recess 16 therein in order to support the EAS sensor. The depth of the recess is preferably defined by the thickness "t" of the first member, and the recess includes a base 44 (FIG. 9) for supporting the EAS sensor, as described below. The top portion 26 of the first member may preferably include an engagement member, which is in the shape of a hook 30 for engagement with a support structure, for example a display rack, rod, or the like, in the present embodiment. The second member may preferably be a mirror image of the first member and may likewise include an outer surface 32, an inner surface 34, a top portion 36 and a bottom portion 38. The top portion 36 may also include hook 40. If the second member is a mirror image of the first member, the inner surface of the second member will substantially overlay the inner surface of the first member when assembled. An adhesive may be placed on the inner surface of the second member, or the first member, or both, in order to secure the first and second members in the assembled position. In the present embodiment, an adhesive is placed over the inner surface of the second member and is covered with a protective sheet (not shown). The protective sheet is removed to expose the adhesive during assembly, as is known in the art.

Figure 12:
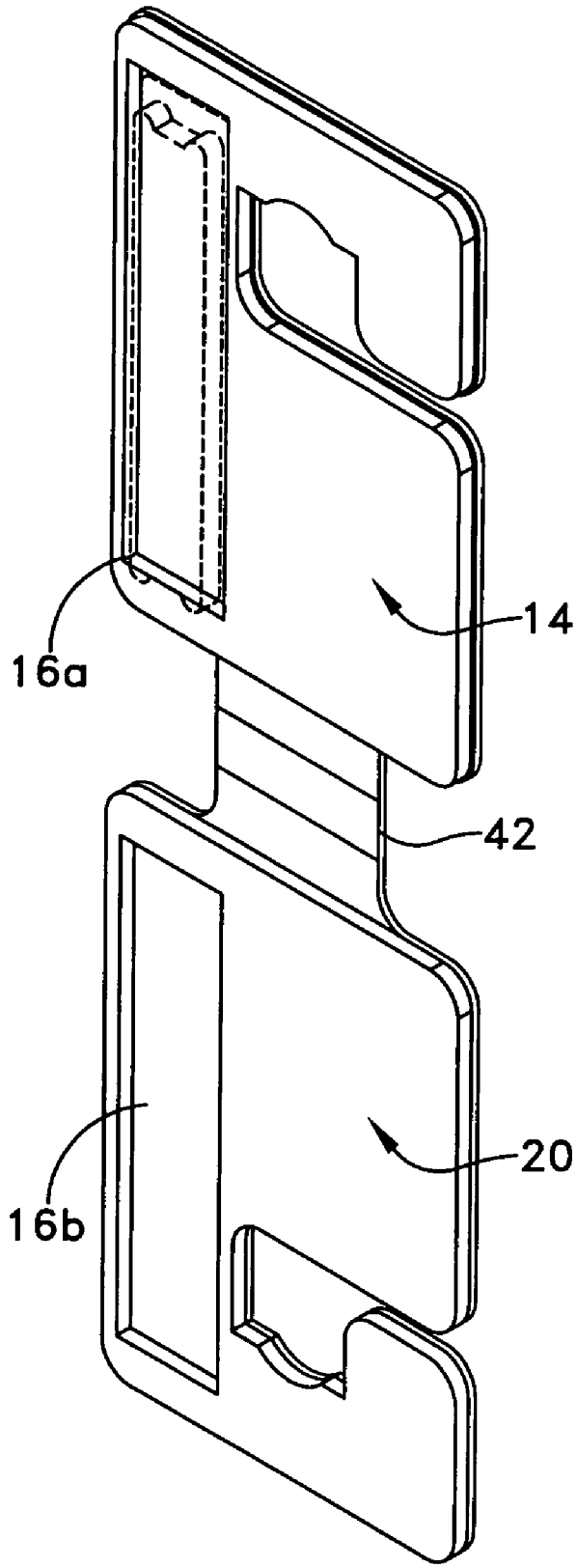
FIG. 12 is a perspective view of a fourth embodiment of the anti-theft display hanger in an open position.

Although the present embodiment illustrates the first member having a thickness sufficient to create a recess to hold the EAS sensor, the thickness may be split between both the first and second member. As illustrated in FIG. 12, if the thickness is split between the first and second member, each member would include a cooperative recess 16*a*, 16*b* that align with, and overlay each other, when assembled. In this manner, a single EAS sensor would be placed within the recess of the first member, but would not be flush with the inner surface of the first member and would, instead, have a thickness greater than inner surface of the first member. However, upon overlaying the second member, the recess formed therein would enclose the EAS marker so that the overall thickness of the body of the first and second members together would be about equal to or greater than that of the EAS sensor. In this manner, the EAS sensor would remain hidden within the body of the hanger because the inner surface of the first and second members are in contact and planar with respect to each other, i.e. there is no visible bulge to indicate the presence of a sensor which is enclosed within the recesses.

Figure 4:
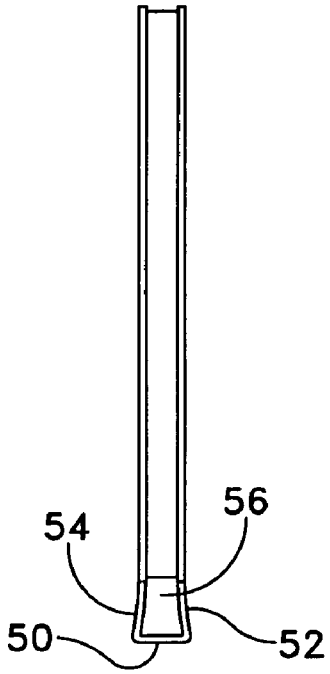
FIG. 4 is left side plan view of the embodiment of FIG. 1.
Figure 5:
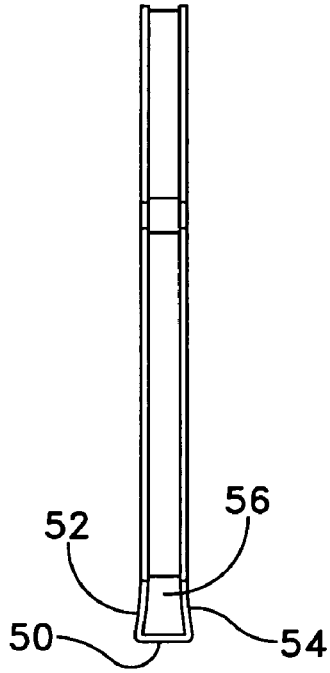
FIG. 5 is a right side plan view of the embodiment of FIG. 1.
Figure 6:
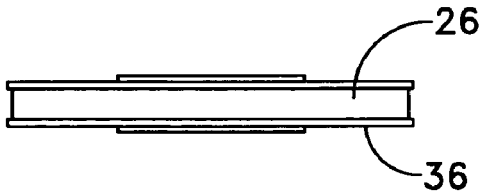
FIG. 6 is a top plan view of the embodiment of FIG. 1.
Figure 7:
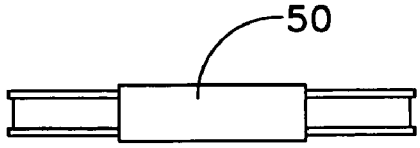
FIG. 7 is a bottom plan view of the embodiment of FIG. 1.
Figure 8:
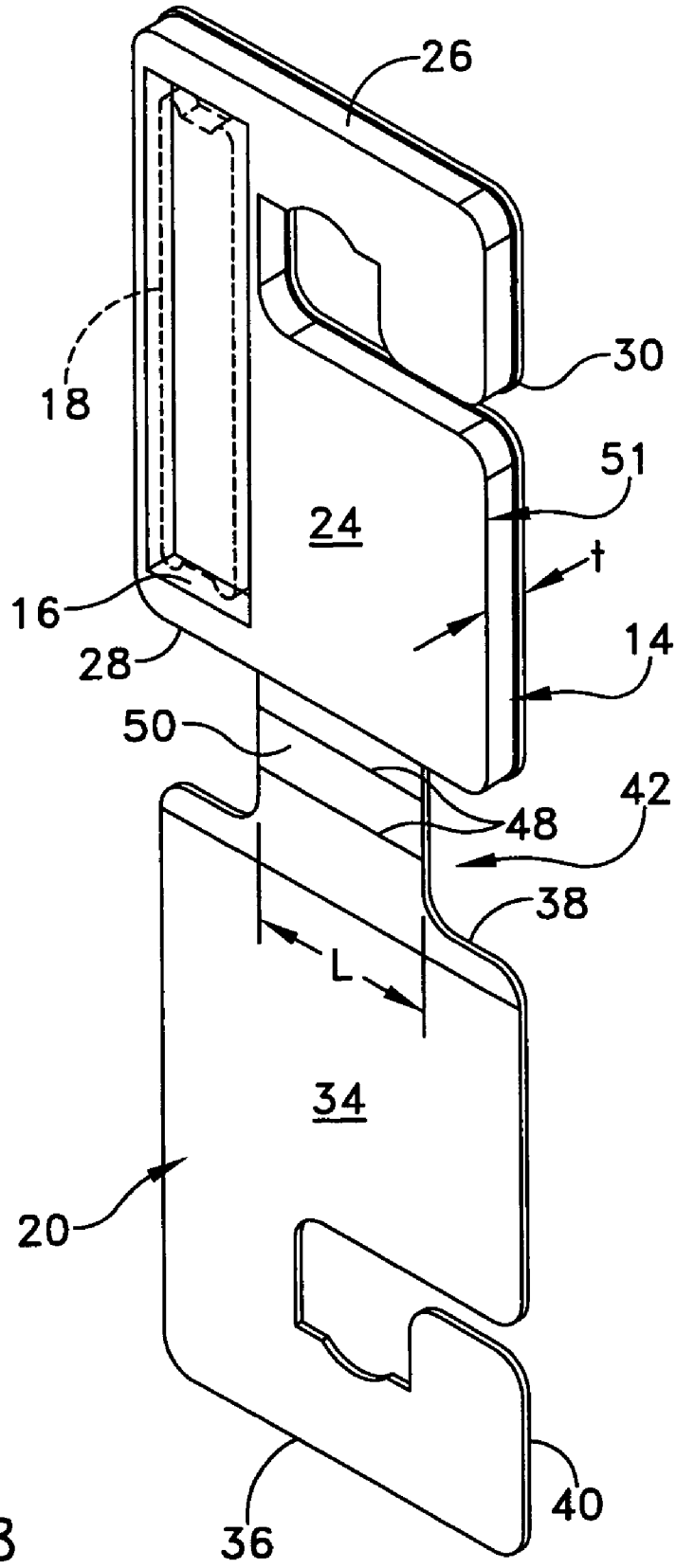
FIG. 8 is a perspective view of the anti-theft tag of FIG. 1 in an open position.
Figure 9:
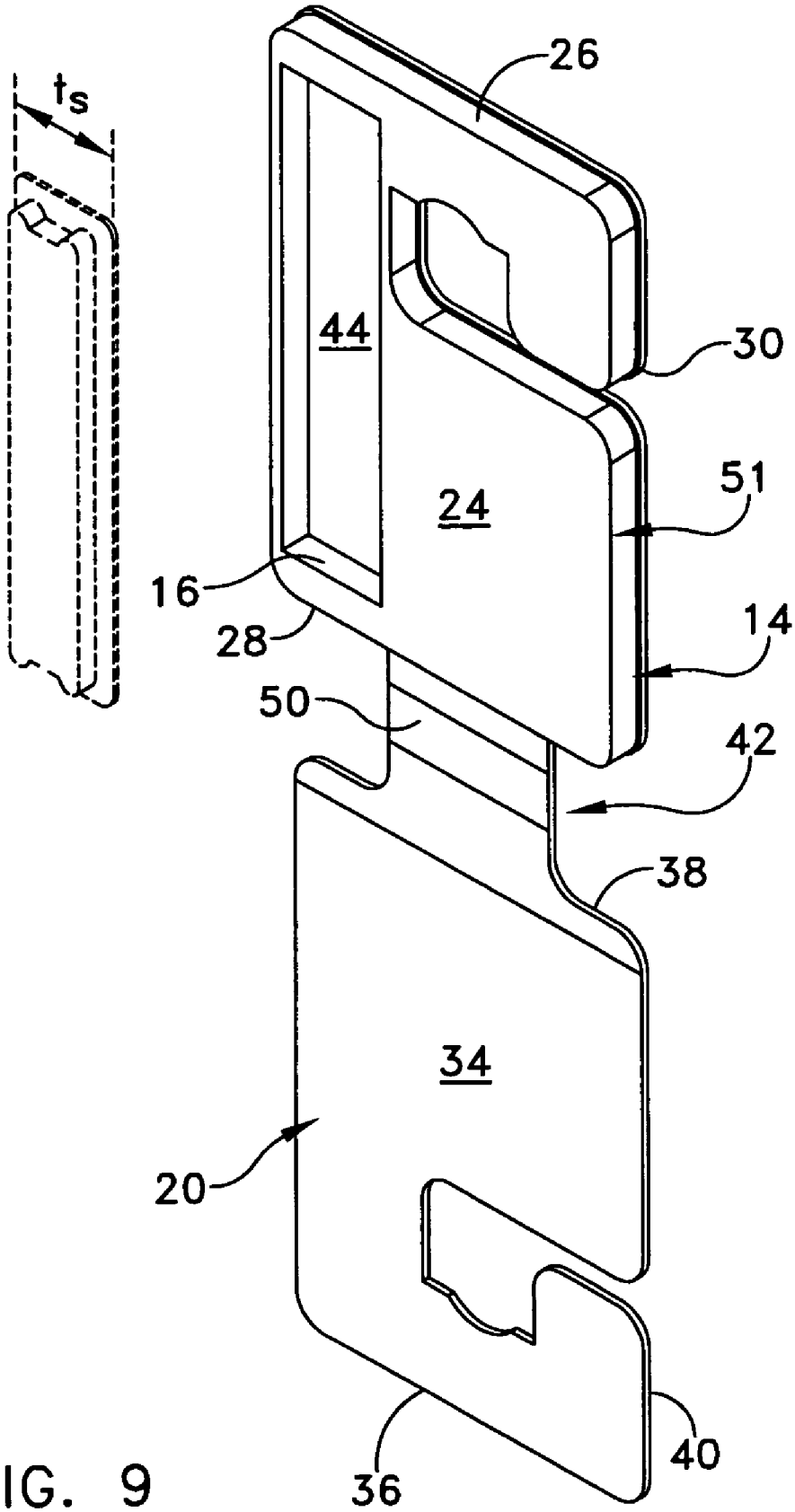
FIG. 9 is an exploded view of the anti-theft hanger of FIG. 1.

The first and second members may preferably be formed as a unitary piece and are connected by bridge 42, as shown in FIGS. 8–9 of the first embodiment. The bridge 42 has a length "L" which may preferably be less than the length of the bottom portion 28, 36 of the first and second members, respectively. A pair of score lines 48 may be formed on the bridge so that when assembled, a planar surface 50 is formed to support an article, such as necklace 58 (FIG. 1). Planar surface 50 is formed between sides 52, 54 of the bridge which are spaced from each other in the assembled position (FIGS. 4–5). In this manner, a passageway 56 is formed, which has a width defined by the width of the planar surface 50. As will be appreciated, the width of the planar surface 50 can be readily varied to accommodate various sized articles. Alternatively, the bridge may be formed as a fold, without spaced sides. For example, FIGS. 10 and 11 show alternate embodiments where the bridge 142 and 242, respectively would form a fold, and not a flat, planar surface, in the assembled position.

Figure 10:
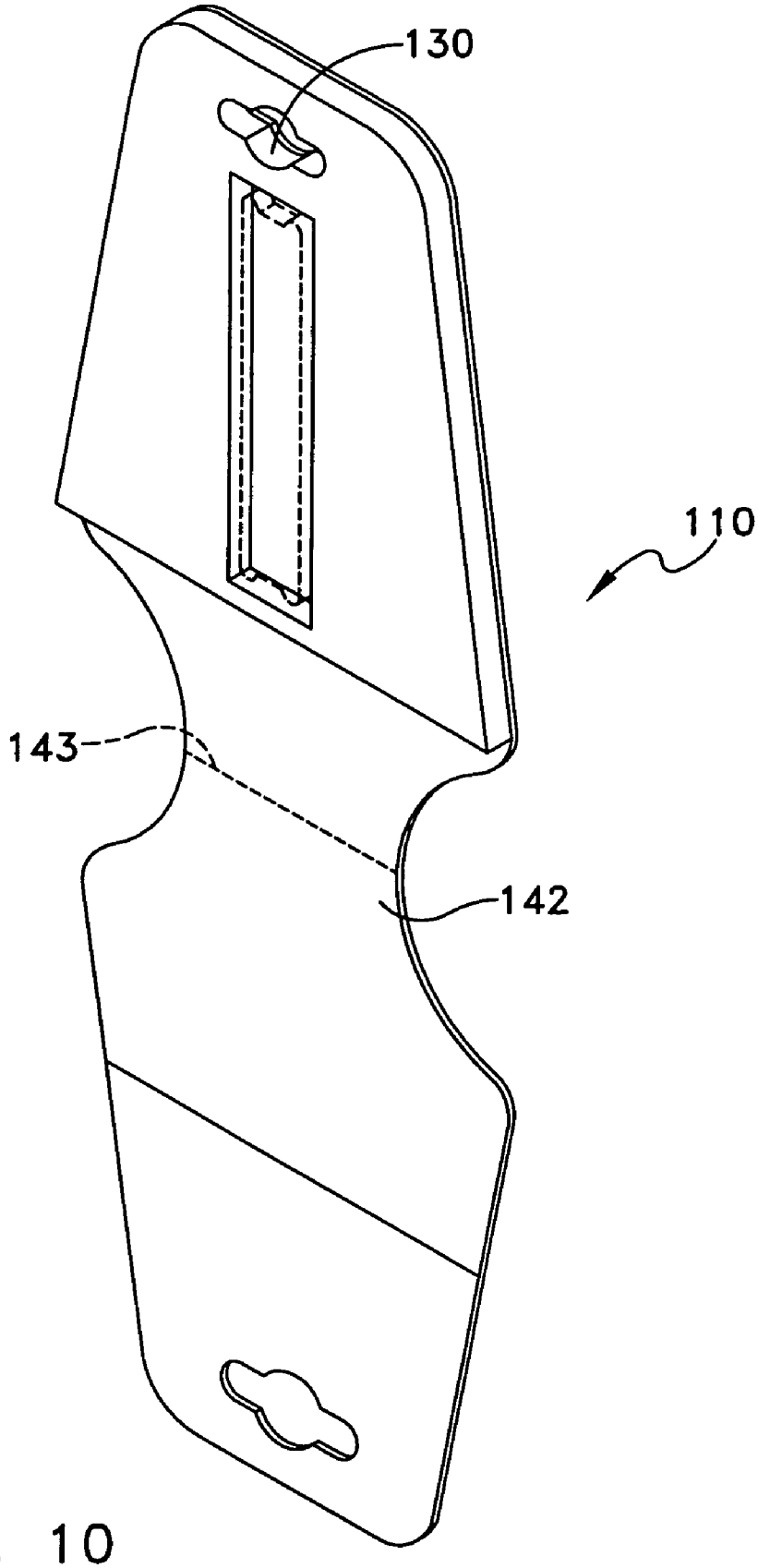
FIG. 10 is a perspective view of a second embodiment of an anti-theft display hanger in an open position.
Figure 11:
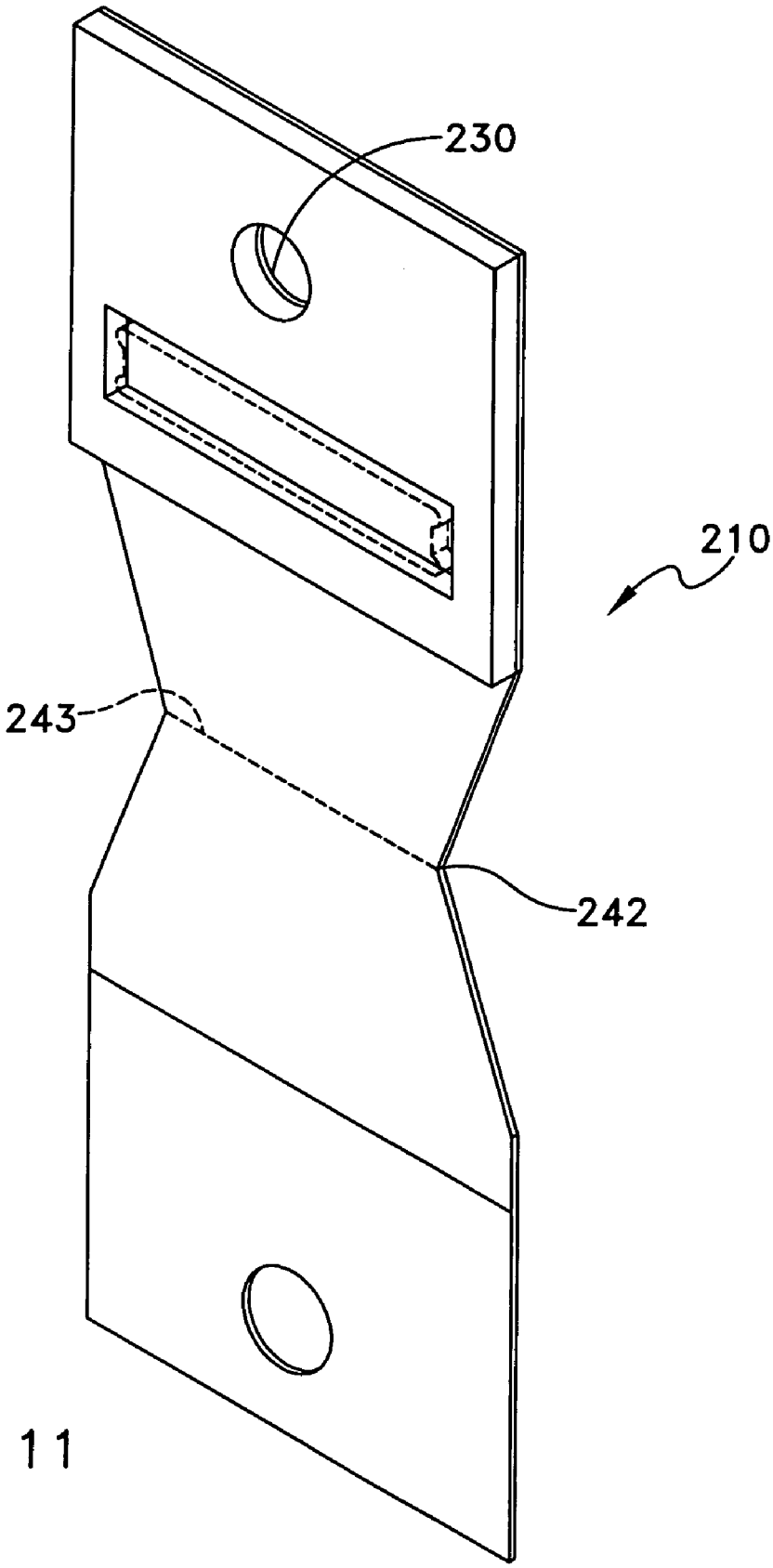
FIG. 11 is a perspective view of a third embodiment of an anti-theft display hanger in an open position.

Referring now to FIGS. 10–11, a second and third embodiment of the anti-theft tag, respectively, is shown. In these embodiments, the engagement member is in the shape of an aperture 130, 230, and the overall shape of the tag is different than the first embodiment. In addition, as discussed above, bridge 142, 242 do not include a planar surface when the second member overlays the first member. Instead, a fold line 143, 243 is formed to support the article. Otherwise, the tags 110 and 210 are substantially the same as the first embodiment.

Use of anti-theft display hanger 10 will now be described with reference to FIGS. 1–9 of the first embodiment.

Prior to assembly, anti-theft display hanger 10 is an open, or non-assembled position as shown in FIGS. 8–9. As illustrated, the first and second members, along with the bridge 42 are in a planar position. In this position, the EAS sensor 18 is placed within the recess 16 formed in the first member 14. The recess 16 may preferably be formed as a through opening in a separate, third member 51 made of a cardboard or foam material, or the like, which may be the same shape and size as the first member 14. The third member is then secured to the first member such that a recess 16 having a base 44 is formed. In the present embodiment, the recess has a depth defined by the thickness "t" of the third member and first member, which is about equal to or greater than the thickness "$t_s$" of the EAS sensor. The EAS marker is supported within the recess, for example by adhesive disposed on the bottom of the EAS marker which is secured to the base 44 of the recess. In this manner, the EAS sensor is flush with the inner surface 24, or below the inner surface. Thus, when assembled, there is no bulge formed, or other indication of the presence of an EAS sensor within the hanger.

Once the EAS sensor is disposed within the recess, the article can be placed on the hanger. For example, if the article is a necklace 58, the necklace may be placed over bridge 42. To secure the article to the hanger, the second member 20 is positioned over the first member (FIGS. 1–7) and is secured thereto. In the present embodiment, the second member is the mirror image of the first member, and the inner surface of the second member includes an adhesive to secure the first and second members together. As the second member is moved into position over the first member, the planar surface 50 for supporting necklace 58 is formed. The planar surface is formed between sides 52, 54 of the bridge which are spaced from each other in the assembled position (FIGS. 4–5). In this manner, a passageway 56 is formed, which has a width sufficient for necklace 58. Indicia (not shown) such as the price, manufacturer, etc. may also be provided on the outer surface of the first and/or second members 22, 32, as desired.

The anti-theft display hanger disclosed herein is easy to assemble, provides support to an article, while helping to prevent theft of the article by supporting a hidden EAS sensor therein, and is cost effective.

It will be understood that various modifications may be made to the embodiment disclosed herein. For example, it should be understood that the display hanger need not be unitary in construction. In addition, the recess may be formed in a unitary first member, i.e., the first member may have a thickness formed as a unitary piece instead of as separate pieces adhered together. Also, although shown as generally rectangular, the hanger may be other shapes, as would be known to those of skill in the art. Additionally, the article supported on the hanger may be any article and is not limited to necklaces, or even jewelry. Therefore, the above description should not be construed as limiting, but merely as exemplifications of a preferred embodiment. Those skilled in the art will envision other modifications within the scope, spirit and intent of the invention.

What is claimed is:

1. An anti-theft display hanger for supporting an article, comprising:

a first member having an outer surface, an inner surface, a top portion, a bottom portion and a thickness defined between the outer surface and inner surface;

a second member having an outer surface, an inner surface, a top portion, a bottom portion and a thickness defined between the outer surface and inner surface, the second member being constructed and arranged to overlay at least a portion of the first member in an assembled position;

a recess formed in at least the inner surface of the first member and having a base to support an electronic article surveillance sensor, the recess being sized to support the sensor therein and having a depth defendant upon the thickness of the first member such that upon supporting the sensor within the recess, the sensor is planar with or below the inner surface of the first member;

an engagement member constructed and arranged to support the hanger on a display;

a bridge disposed between the bottom portion of the first member and the bottom portion of the second member, the bridge connecting the first member to the second member and forming a pair of sides, the sides being spaced from each other and including a planar surface disposed there between, the planar surface constructed and arranged to support the article thereon; and wherein upon assembling the hanger, the second member overlays the first member so as to conceal the electronic article surveillance sensor, and wherein upon assembling, the bridge supports the article thereon.

2. The display hanger of claim 1, wherein the second member is a mirror image of the first member.

3. The anti-theft display hanger of claim 1, further comprising a third member, the third member having a through opening sized to fit the sensor and being supported on the first member such that the through opening and the first member together form the recess.

4. The anti-theft display hanger of claim 3, wherein the depth of the recess is defined by the thickness of the first member and third member.

5. The anti-theft display hanger of claim 1 wherein the bridge includes a pair of score lines constructed and arranged to form the planar surface upon assembling the hanger.

6. The anti-theft display hanger of claim 1, wherein the second member includes an adhesive on the inner surface.

7. The anti-theft display hanger of claim 1, wherein the engagement member is a hook.

8. An anti-theft display hanger for supporting an article, comprising:

a first member having an outer surface, an inner surface, a top portion, a bottom portion and a thickness defined between the outer surface and inner surface;

a second member having an outer surface, an inner surface, a top portion, a bottom portion and a thickness defined between the outer surface and inner surface, the second member being constructed and arranged to overlay at least a portion of the first member in an assembled position;

a recess formed in at least the inner surface of the first member and having a base to support an electronic article surveillance sensor, the recess being sized to support the sensor therein;

a recess formed in at least the inner surface of the second member, the recess being sized to receive the sensor therein and being aligned with the recess of the first member such that upon assembling the hanger, the recess of the second member is aligned with and overlays the recess of the first member so as to enclose the sensor;

an engagement member constructed and arranged to support the hanger on a display;

a bridge disposed between the bottom portion of the first member and the bottom portion of the second member, the bridge connecting the first member to the second member and forming a pair of sides, the sides being spaced from each other and including a planar surface disposed there between, the planar surface constructed and arranged to support the article thereon; and wherein upon assembling the hanger, the second member overlays the first member so as to conceal the electronic article surveillance sensor, and wherein upon assembling, the bridge supports the article thereon.

9. The anti-theft display hanger of claim 8, wherein the recess of the first member includes a depth defined by a thickness of the first member, and the recess of the second member includes a depth defined by a thickness of the second member, such that upon enclosing the sensor within the first and second recess, the inner surface of the first and second members are in contact and planar with respect to each other.

10. An anti-theft display hanger for supporting an article, comprising:

a first member having an outer surface, an inner surface, a top portion, a bottom portion and a thickness defined between the outer surface and inner surface;

a second member having an outer surface, an inner surface, a top portion, a bottom portion and a thickness defined between the outer surface and inner surface, the second member being a mirror image of the first member and being constructed and arranged to overlay at least a portion of the first member in an assembled position;

a recess formed in at least the inner surface of the first member and having a base to support an electronic article surveillance sensor, the recess being sized to support the sensor therein and including a depth defined by a thickness of the first member, such that upon supporting the sensor within the recess, the sensor is planar with or below the inner surface of the first member;

an engagement member constructed and arranged to support the hanger on a display;

a bridge disposed between the bottom portion of the first member and the bottom portion of the second member, the bridge connecting the first member to the second member and including a pair of score lines; and wherein upon assembling the hanger, the second member overlays the first member so as to conceal the electronic article surveillance sensor, and wherein upon assembling, the bridge is folded at the score lines so as to form a pair of sides which are spaced from each other and which include a planar surface disposed there between, the planar surface constructed and arranged to support the article thereon.

11. The anti-theft display hanger of claim 10, further comprising a third member, the third member having a through opening sized to fit the sensor and being supported on the first member such that the through opening and the first member together form the recess.

12. The anti-theft display hanger of claim 11, wherein the depth of the recess is defined by the thickness of the first member and third member.

13. The anti-theft display hanger of claim 10, wherein the engagement member is a hook.

14. The display hanger of claim 10, wherein the first and second members are formed as a unitary piece.

15. The anti-theft tag of claim 10, wherein the bridge has a length which is less than a length of the bottom portion of the first member and which is less than a length of the bottom portion of the second member.

16. A method of making an anti-theft display hanger for supporting an article, comprising the steps of:

providing a first member having an outer surface, an inner surface, a top portion, a bottom portion and a thickness defined between the outer surface and inner surface;

providing a second member having an outer surface, an inner surface, a top portion, a bottom portion and a thickness defined between the outer surface and inner surface, the second member being a mirror image of the first member and being constructed and arranged to overlay at least a portion of the first member in an assembled position;

forming a recess in at least the inner surface of the first member, the recess including a base to support an electronic article surveillance sensor, the recess being sized to support the sensor therein and including a depth defined by a thickness of the first member;

providing a bridge disposed between the bottom portion of the first member and the bottom portion of the second member, the bridge connecting the first member to the second member and having a length which is less than a length of the bottom portion of the first member and which is less than a length of the bottom portion of the second member;

inserting the sensor within the recess, wherein the sensor is planar with or below the inner surface of the first member.

17. The method of claim 16, further comprising the steps of:

folding the bridge member so as to form a pair of sides which are spaced from each other and which include a planar surface disposed there between, the planar surface constructed and arranged to support the article;

overlaying the first member with the second member so as to conceal the electronic article surveillance sensor; and securing the second member to the first member.

* * * * *